US007380452B1

(12) United States Patent
Sarshar et al.

(10) Patent No.: US 7,380,452 B1
(45) Date of Patent: Jun. 3, 2008

(54) METHOD OF DETERMINING FUSE PARAMETERS FOR A MECHANICAL FUSE IN A GAS COMPRESSOR

(75) Inventors: Hamid Reza Sarshar, The Woodlands, TX (US); Vinh K. Do, Houston, TX (US); Simone Pratesi, Vicchio (IT); Nicola Campo, Florence (IT); Jeffrey Raynal, Houston, TX (US)

(73) Assignee: Nuovo Pignone Holdings, S.p.A., Florence (IT)

( * ) Notice: Subject to any disclaimer, the term of this patent is extended or adjusted under 35 U.S.C. 154(b) by 0 days.

(21) Appl. No.: 11/680,017

(22) Filed: Feb. 28, 2007

(51) Int. Cl.
*G01M 19/00* (2006.01)

(52) U.S. Cl. ..... 73/168

(58) Field of Classification Search ..... 73/168
See application file for complete search history.

(56) References Cited

U.S. PATENT DOCUMENTS 2,964,235 A * 12/1960 Welchon ..... 417/298
5,146,791 A * 9/1992 Peter et al. ..... 73/862.49
5,525,975 A * 6/1996 Walker et al. ..... 340/870.01
5,836,567 A * 11/1998 Watanabe ..... 251/129.12
6,540,481 B2 * 4/2003 Moussa et al. ..... 415/208.2
6,794,766 B2 9/2004 Wickert et al.
6,969,239 B2 11/2005 Grant et al.
7,101,151 B2 9/2006 Loringer et al.

* cited by examiner

*Primary Examiner*—Andre J Allen
(74) *Attorney, Agent, or Firm*—Nixon & Vanderhye P.C.

(57) ABSTRACT

A method of determining fuse parameters in a reciprocating gas compressor ensures a safe failure upon exceeding an overload limit. Stresses and bolted joint behavior for critical components in compressor running gear are evaluated using a finite element analysis. Capabilities of the critical components during an overload event are evaluated using a propagation and variances tool. The capabilities of the critical components are compared against overload conditions. At least one of an optimal fuse location and a fuse geometry are determined according to the comparison to establish a safe failure point upon exceeding the overload limit. With a mechanical fuse defining a failure point, critical compressor components can be protected from damage, and personnel can be protected from risk of a gas leakage.

8 Claims, 2 Drawing Sheets

METHOD OF DETERMINING FUSE PARAMETERS FOR A MECHANICAL FUSE IN A GAS COMPRESSOR

BACKGROUND OF THE INVENTION

The invention relates to gas compressor maintenance and reliability and, more particularly, to a method that ensures a safe failure upon exceeding an overload limit.

An overload condition in a gas compressor can cause damage to compressor components that may affect operation and efficiency of the compressor. Repeated overload occurrences can compound damage to the compressor components, often beyond repair.

During an overload event, the compressor can fail at an undesirable location that can lead to catastrophic frame damage. Additionally, personnel safety can be compromised due to gas leakage. It would be desirable to implement a mechanical fuse at a desirable location that will allow the compressor to fail in a safe and controlled manner in the event of an overload condition.

BRIEF DESCRIPTION OF THE INVENTION

In an exemplary embodiment of the invention, a method of determining fuse parameters in a reciprocating gas compressor ensures a safe failure upon exceeding an overload limit. The method includes the steps of (a) evaluating stresses and joint separation behavior for critical components in compressor running gear, including at least one of a connecting rod, a crosshead, a piston rod, a piston assembly, and bolted connections using a finite element analysis; (b) evaluating capabilities of the critical components during an overload event using a propagation of variances tool; (c) comparing the capabilities of the critical components against overload conditions; and (d) determining at least one of an optimal fuse location and a fuse geometry according to the comparison in step (c) to establish a safe failure point upon exceeding the overload limit.

In another exemplary embodiment of the invention, a method of forming the mechanical fuse includes an additional step of forming the fuse according to the optimal fuse location and fuse geometry determined in step (d).

In still another exemplary embodiment of the invention, a method of determining fuse parameters in a reciprocating gas compressor ensures a safe failure upon exceeding an overload limit and includes the steps of utilizing a probabilistic approach to determine a likelihood of failure to occur at a fuse location, and comparing the likelihood of failure to critical components in compressor running gear through propagation of variances software.

DETAILED DESCRIPTION OF THE INVENTION

Gas compressors and systems are used to pressurize and circulate gas through a process, enhance conditions for chemical reactions, provide inert gas for safety or control systems, recover and recompress process gas, and maintain correct pressure levels by either adding and removing gas or vapors from a process system. Gas compressors work in multiple stages (up to four). In the first stage, gas flows through an inlet check valve and fills a larger diameter first-stage cylinder. A piston assembly is driven in one direction, compressing the gas in the first-stage cylinder. Gas in the first-stage cylinder flows through suitable valves into a smaller diameter second-stage cylinder.

At the end of the first stage, the piston assembly is driven in the other direction compressing gas in a second-stage cylinder. Further compression stages operate to further compress the gas, and after the last compression stage, gas flows out of the last-stage cylinder into a discharge gas line. The piston assembly reverses direction at the end of the stroke, and the cycle repeats.

There are four broad categories of compressor types. There are many variations within each type: reciprocating compressor, fan/blower compressors, rotary compressors, and ejector compressors.

In a reciprocating compressor, the thrust of a piston, within the cylinder, moves the gas through the system. This thrust enhances both the pressure and the density of the gas being transported. The reciprocating compressor is typically driven by a natural gas or diesel engine. The engine drives the crankshaft (rotational motion), and this rotational motion is converted to reciprocating motion through a series of components (connecting rod, crosshead, piston rod, piston assembly). Gas enters the cylinder body through suction valves (some cylinders have four valves while others have two valves), and the gas is compressed by the piston assembly through its reciprocating motion. After being compressed, the gas goes through the discharge valves and then onto the next stage of compression. The reciprocating compressor can be multi-staged up to four stages depending on flow, pressure, and horsepower requirements.

During normal operation, an overload event can occur when the compressor cylinder body ingests an incompressible material/object. The incompressible material/object can come in the form of a liquid (condensation, liquid carryover) or a solid (broken valve pieces, parts of piston assembly, any foreign matter in the cylinder body). An overload event can cause component failure at an undesirable location, which can lead to catastrophic frame damage, and personnel safety can be compromised due to gas leakage. Implementing a mechanical fuse at a desirable location will allow the compressor to fail in a safe and controlled manner.

Figure 1:
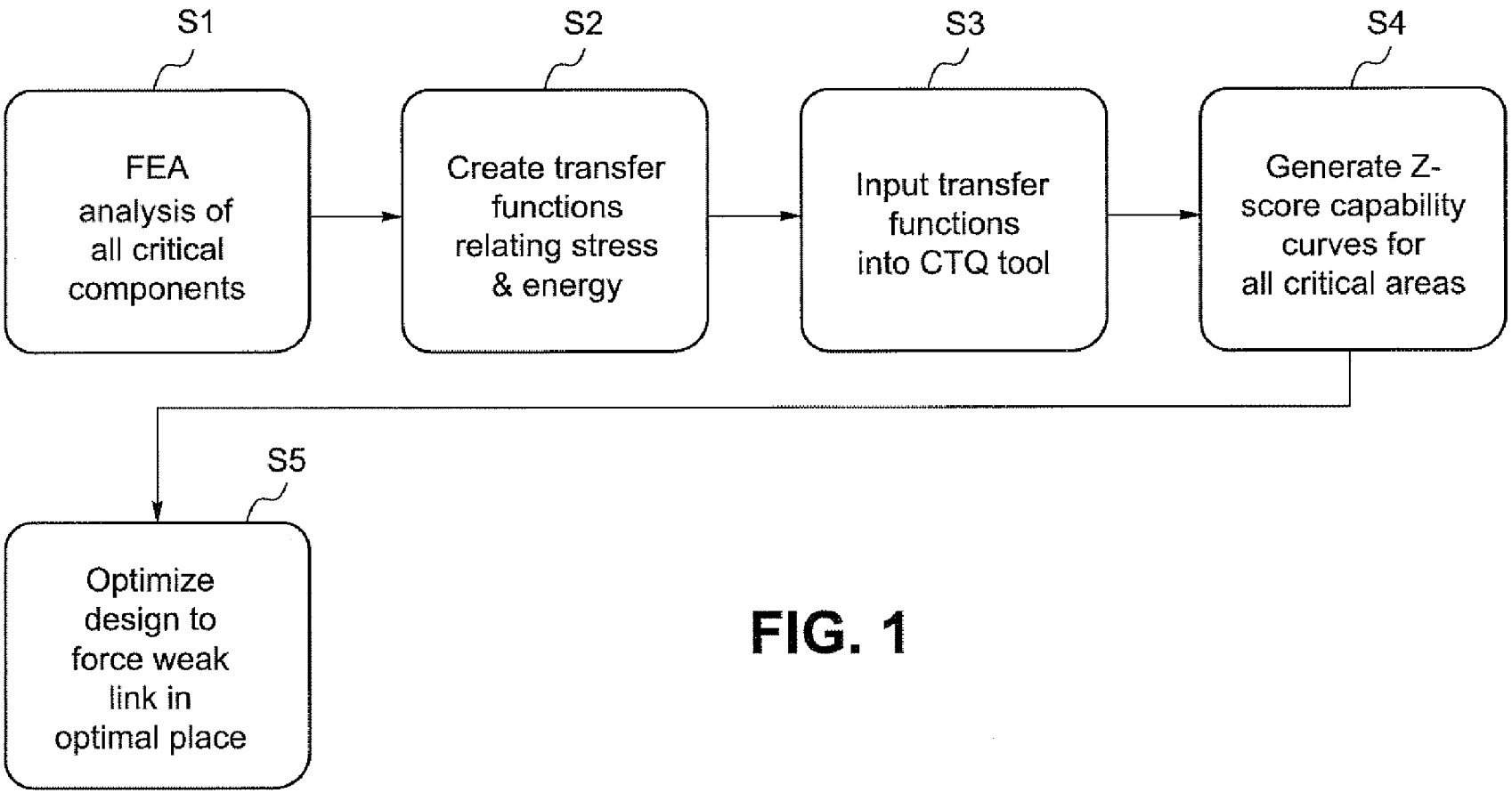
FIG. 1 is a flow chart of the process for determining fuse parameters.

FIG. 1 is a flow chart showing a process for determining fuse parameters (e.g., location and geometry) for a reciprocating gas compressor to ensure a safe failure upon exceeding an overload limit. In step S1, a finite element analysis and joint separation evaluation are performed for all critical components. Critical components are defined as running gear and include at least a connecting rod, a crosshead, a piston rod, a piston assembly, and bolted connections. A failure at any of the critical components can lead to catastrophic frame damage, and personnel safety can be compromised due to gas leakage. In the analysis, the effect of impact (via an overload event) is considered through the use of a strain energy approach.

In step S2, transfer functions relating stress and energy are created, and a stress state during a loading condition is converted to an energy state via the transfer functions. The component design is compromised when the energy state during an overload event is equal to the total energy that the material can absorb (based on the material's ultimate tensile strength).

The transfer functions are input to a "CTQ" (critical to quality) tool in step S3, which is a propagation of variances tool to account for design and process variances to evaluate the capabilities of all critical components during an overload event. In step S4, a series of curves comparing critical components capabilities (Z-score) against overload conditions is output. Based on this comparison, in step S5, an optimal fuse location is determined according to this comparison to establish a safe failure point upon exceeding the overload limit. The optimal fuse location is determined by upgrading by the performance of the critical components to force the fuse to a desired location and/or provide a fuse geometry at the desired location.

In this manner, using the finite element analysis, it is determined at what overload condition one of the critical components would fail. With this determination, a weak link in a safe failure location is created so that upon the occurrence of an overload event that would ordinarily cause one of the critical components to fail, a failure rather occurs at the weak link to thereby ensure a safe failure.

Figure 2:
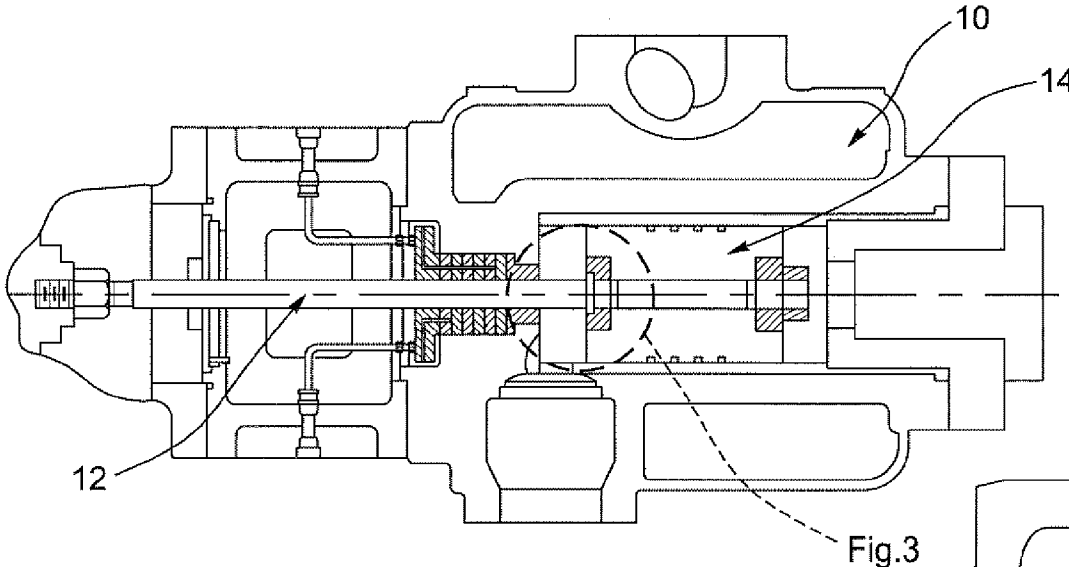
FIG. 2 is a cross-sectional view of the compressor through the piston.
Figure 3:
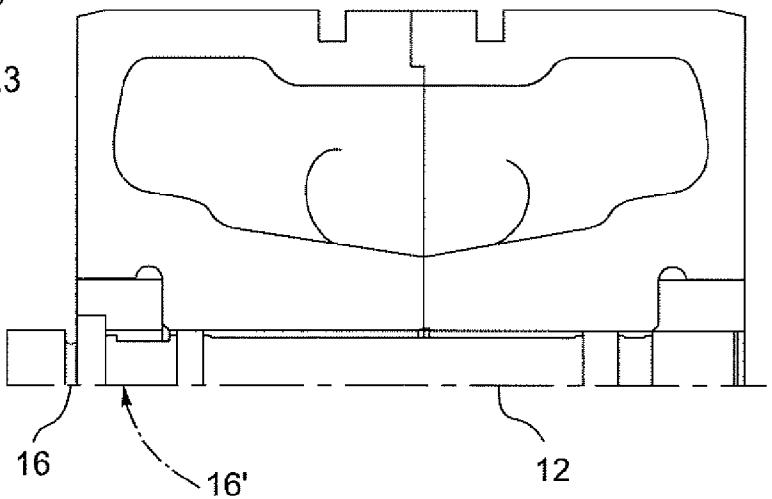
FIG. 3 is a close-up view of a portion identified in FIG. 2.

With reference to FIGS. 2 and 3, a suitable area of interest for the mechanical fuse is located on the piston rod 12 near the piston assembly 14 in the cylinder 10. As shown in FIG. 3, the mechanical fuse 16 in a preferred construction is a simple relief cut on the outside diameter of the piston rod 12 that, when under tensile overloads, has the highest probability to fail. Failure at this location will push the piston assembly 14 to one side and allow the piston rod 12 to continue running, thus sealing the gases until the unit is shut down and serviced. An alternate mechanical fuse location is shown in FIG. 3 at 16'.

The method described herein provides for the determination of parameters for a mechanical fuse in a reciprocating gas compressor that will fail in a safe and controlled manner in the event of an overload condition. The fuse prevents catastrophic frame damage due to critical component failure and also serves to protect personnel from gas leakage as a result of component failure. Once the fuse parameters are determined, implementation of the fuse can be a simple process.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of determining fuse parameters in a reciprocating gas compressor to ensure a safe failure upon exceeding an overload limit, the method comprising:

(a) evaluating stresses and joint separation behavior for critical components in compressor running gear, including at least one of a connecting rod, a crosshead, a piston rod, and a piston assembly, and bolted connections using a finite element analysis;

(b) evaluating capabilities of the critical components during an overload event using a propagation of variances tool;

(c) comparing the capabilities of the critical components against overload conditions; and (d) determining at least one of an optimal fuse location and a fuse geometry according to the comparison in step (c) to establish a safe failure point upon exceeding the overload limit.

2. A method according to claim 1, further comprising converting critical component stresses evaluated in step (a) to strain energy, wherein step (c) is practiced by comparing an energy state during overload conditions with a strain energy limit for each of the critical components.

3. A method according to claim 2, wherein a design of the critical components is compromised when the energy state during overload conditions is equal to or exceeds the respective strain energy limit.

4. A method of forming a mechanical fuse to ensure a safe failure upon exceeding an overload limit, the method comprising:

(a) evaluating stresses for critical components and joint separation behavior in compressor running gear, including at least one of a connecting rod, a crosshead, a piston rod, a piston assembly, and bolted connections using a finite element analysis;

(b) evaluating capabilities of the critical components during an overload event using a propagation of variances tool;

(c) comparing the capabilities of the critical components against overload conditions;

(d) determining at least one of an optimal fuse location and a fuse geometry according to the comparison in step (c) to establish a safe failure point upon exceeding the overload limit; and (e) forming the fuse according to the optimal fuse location and fuse geometry determined in step (d).

5. A method according to claim 4, wherein step (e) is practiced by making a relief cut in an outside diameter of the piston rod.

6. A method according to claim 5, further comprising converting critical component stresses evaluated in step (a) to strain energy, wherein step (c) is practiced by comparing an energy state during overload conditions with a strain energy limit for each of the critical components.

7. A method according to claim 6, wherein a design of the critical components is compromised when the energy state during overload conditions is equal to or exceeds the respective strain energy limit.

8. A method of determining fuse parameters in a reciprocating gas compressor to ensure a safe failure upon exceeding an overload limit, the method comprising utilizing a probabilistic approach to determine a likelihood of failure to occur at a fuse location, and comparing the likelihood of failure to critical components in compressor running gear through propagation of variances software.

* * * * *